United States Patent [19]

Hess

[11] 4,194,321

[45] Mar. 25, 1980

[54] OVEN HINGE MECHANISM INCLUDING DETENT LOCK

[75] Inventor: Gerald W. Hess, Oxford, Miss.

[73] Assignee: Chambers Corporation, Oxford, Miss.

[21] Appl. No.: 857,614

[22] Filed: Dec. 5, 1977

[51] Int. Cl.[2] ..... E05D 7/10; F23M 7/00; F24C 15/02

[52] U.S. Cl. ..... 49/389; 126/194

[58] Field of Search ..... 49/381, 389, 465; 126/194, 191

[56] References Cited

U.S. PATENT DOCUMENTS

| | | | |
|---|---|---|---|
| 3,003,495 | 10/1961 | Coultrip | 126/194 |
| 3,150,659 | 9/1964 | Ellis et al. | 126/194 |

*Primary Examiner*—Philip C. Kannan

*Attorney, Agent, or Firm*—Richards, Harris & Medlock

[57] ABSTRACT

A mechanism for use with a removable hinged oven door is provided and includes a hinge bracket pivotally secured to the oven housing. A channel frame is secured within the oven door and is adapted to receive the hinge bracket for rendering the door pivotally cooperative with the hinge bracket for movement between a door closed position and a door open position. A lever is pivotally secured to the hinge bracket for movement between first and second positions. In the first position the lever engages the channel frame to prevent removal of the door from the hinge bracket. In the second position the lever disengages from the channel frame to permit removal of the door from the hinge bracket and further maintains the hinge bracket in a predetermined position with respect to the oven structure when the door is removed from the hinge bracket.

19 Claims, 5 Drawing Figures

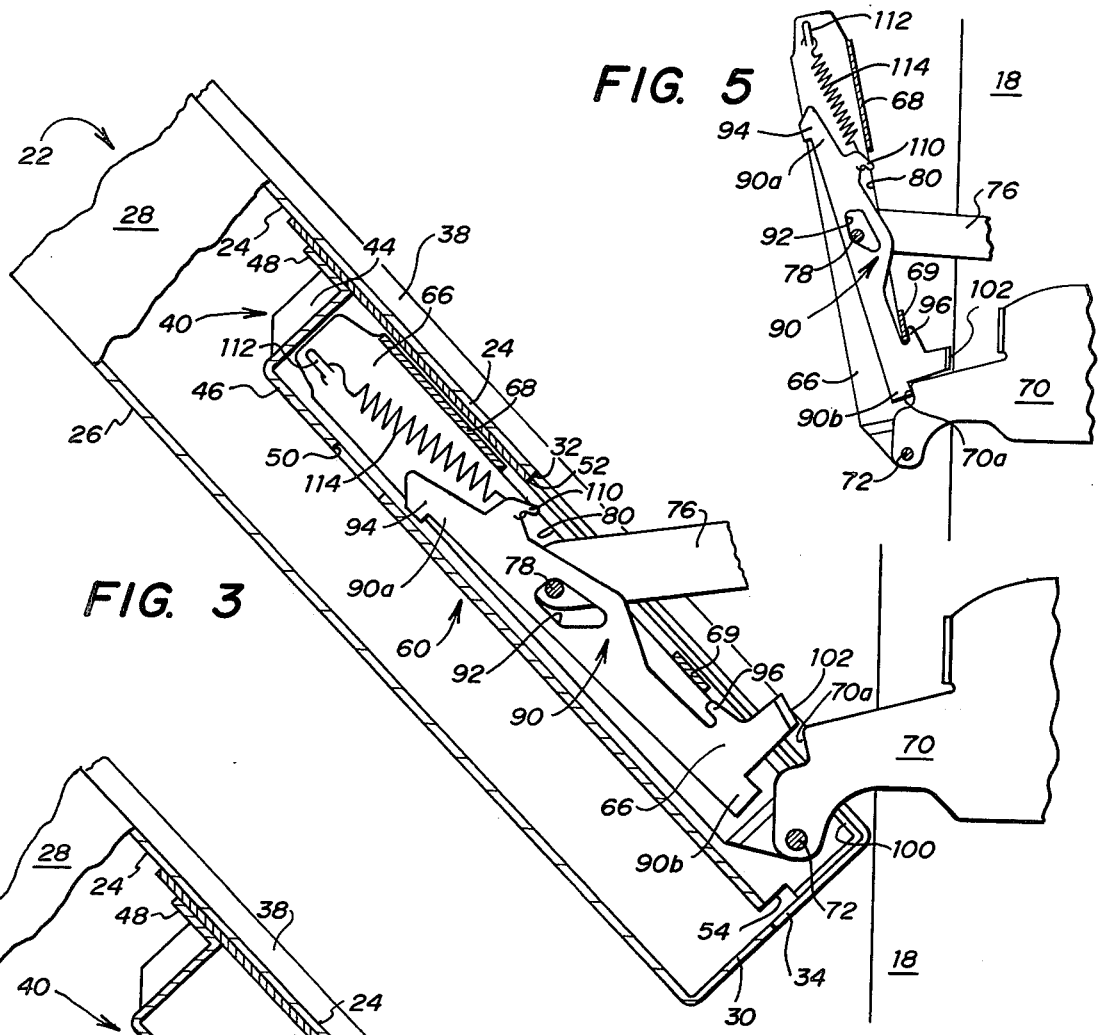
FIG. 3
FIG. 5
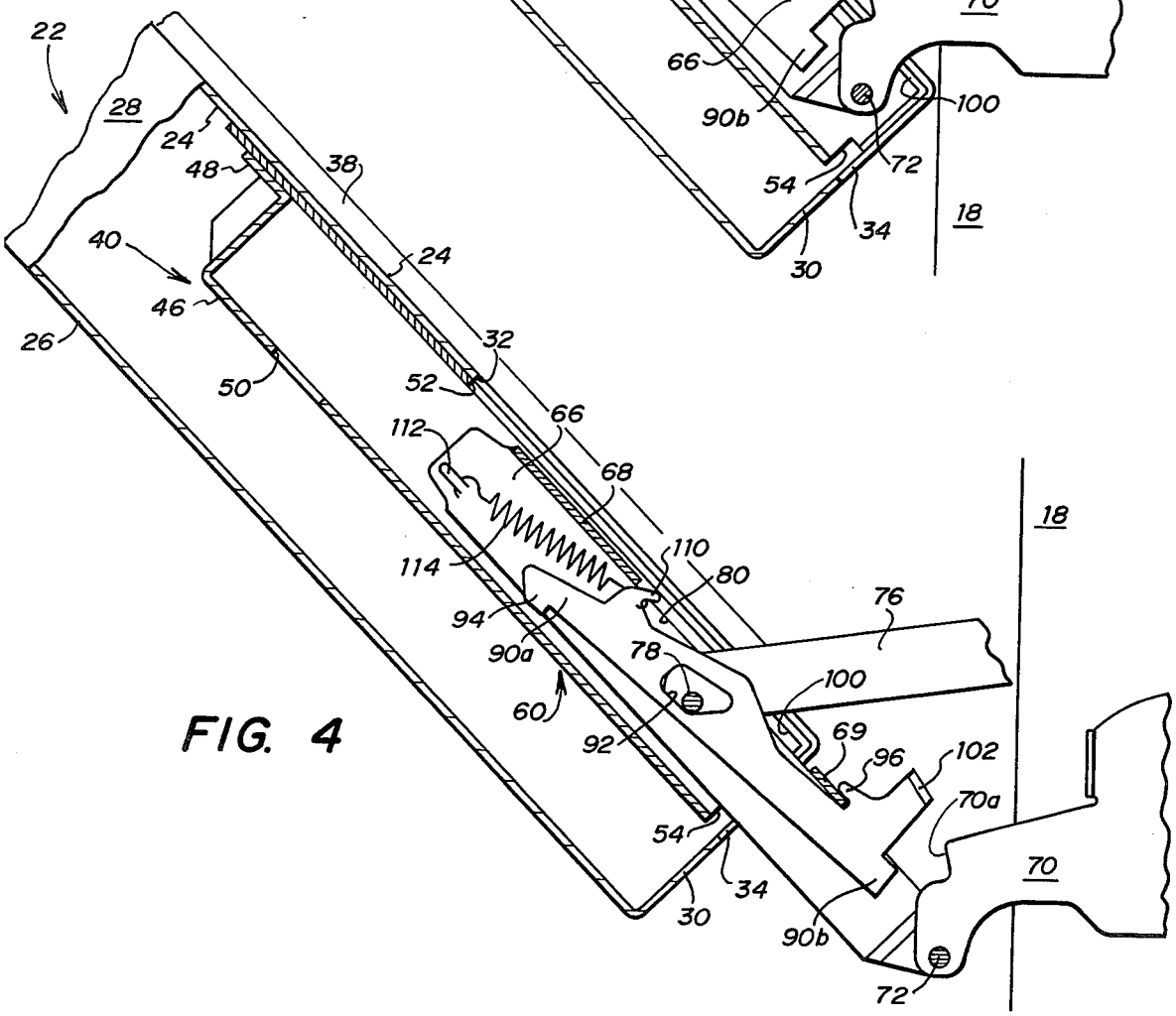
FIG. 4

OVEN HINGE MECHANISM INCLUDING DETENT LOCK

FIELD OF THE INVENTION

This invention relates to a hinge mechanism, and more particularly to an oven hinge mechanism for a removable hinged door.

THE PRIOR ART

Oven doors are generally hinged to swing from a vertical closed position to a horizontal open position in which the door extends horizontally outward from the oven. Access to the interior of an oven for cleaning and repair is difficult while the door projects horizontally in the open position. Stretching across the projecting door requires a long reach and places an individual in an awkard position to gain access to the rearmost portions of the interior of the oven.

In an attempt to solve these problems, various arrangements have been proposed for the complete removal of the oven door. However, this solution poses other problems in the manufacture and use of removable hinged doors. For example, the door must be easy to remove for the oven user to take advantage of this feature when cleaning the oven. A hinge mechanism to allow removal of the door, therefore, must be simple to operate and reliable to withstand several operations during the life of the oven. The hinge mechanism should preferably also include a feature in which the door will be locked to the hinge mechanism to prevent inadvertent disengagement of the door from the hinge which would create an unsafe condition. Further, since the hinge mechanism of oven doors are usually spring biased toward the oven housing, once a door is removed from the hinge, thereby removing the counterbalancing force exerted by the weight of the door on the spring, the spring will cause the hinge mechanisms to abruptly spring back towards the frame of the oven structure. This abrupt movement creates a hazardous condition for the user in that the user's fingers or other portions of his body may be caught between the hinge mechanism and the frame of the oven as the hinge mechanism springs back as the door is removed.

A previously developed hinge mechanism for use with a removable oven door is described and claimed in U.S. Pat. No. 3,003,495 to Coultrip, entitled "Hinge Construction" issued Oct. 10, 1961. However, this and other prior art devices have required a substantial number of components for a hinge mechanism, which adds to the cost of construction and material and tends to render the device less reliable over the life of the oven.

A need has thus arisen for a hinge mechanism for use with a removable hinged oven door which is easy to remove and replace, while at the same time insuring the safety of the user. Such a hinge mechanism needs to provide a locking feature to lock the door to the hinge mechanism at all times except when desired to be removed by the user. The locking mechanism must therefore be easy to unlock. Moreover, a need has arisen for a hinge mechanism that will remain in a position to accept return of an oven door, such that no realignment of the hinge and door is necessary to replace the door to the oven structure. Furthermore, a need has arisen for a hinge mechanism that will prevent the hinge mechanism from moving under the force of a biasing spring to prevent injury to the oven user when removing the oven door.

SUMMARY OF THE INVENTION

In accordance with the present invention, a hinge mechanism for use with a removable hinged oven door is provided which allows the door to be readily removed and replaced in a safe manner. The mechanism permits the oven door to be locked to a hinge mechanism until it is desired to remove the door and further maintains the hinge mechanism in a position to accept return of the door when it is desired to replace the door on the oven structure.

In accordance with the present invention, a mechanism for use with a removable hinged door for an oven structure includes a hinge bracket pivotally secured to the oven structure. A channel frame is secured within the door and is adapted to receive the hinge bracket for rendering the door pivotally cooperative with the hinge bracket for movement between a door closed position and a door open position. The mechanism further includes a lever pivotally secured to the hinge bracket for movement between first and second positions. In the first position, the lever engages the channel frame to prevent the removal of the door from the hinge bracket. In the second position the lever disengages from the channel frame to permit removal of the door from the hinge bracket and further maintains the hinge bracket in a predetermined position with respect to the oven structure when the door is removed from the hinge bracket to accept the return of the door.

In accordance with another aspect of the present invention, a mechanism for use with a removable hinged door for an oven structure includes a hinge bracket pivotally secured to the oven structure. A channel frame is secured within the door for slidable engagement with the hinge bracket for removably mounting the door thereto. A lever having first and second ends is housed within the hinge bracket and is pivotally secured to the hinge bracket at a point centrally disposed between the lever first and second ends, for movement between first and second positions. The first end of the lever includes a detent extending from the hinge bracket in the first position for engaging the channel frame to prevent removal of the door from the hinge bracket. The first end of the lever is retractable into the hinge bracket in the second position to disengage from the channel frame to permit removal of the door from the bracket. The second end of the lever includes a detent extending from the hinge bracket in the second position for engaging the hinge bracket to maintain it in a predetermined position with respect to the oven structure when the door is removed from the hinge bracket. The detent of the second end of the lever is retractable into the hinge bracket when the door is mounted to the hinge bracket. The mechanism further includes structure mounted to the second end of the lever extending outwardly from the hinge bracket and the door for actuating the lever for movement between the first and second lever positions. A spring is provided having first and second ends and is contained within the hinge bracket for biasing the lever to the hinge bracket. The first end of the spring is attached to the hinge bracket, and the second end of the spring is attached to the lever.

DESCRIPTION OF THE DRAWINGS

For a more complete understanding of the present invention and for further objects and advantages thereof, reference is now made to the following detailed description taken in conjunction with the accompanying drawings, in which:

FIG. 3 is a side elevational view, in section, showing the position of the mechanism of the present invention as the mechanism moves from the locked position to a position to permit removal of the door from the hinge bracket;

FIG. 4 is a side elevational view, in section, showing the position of the mechanism of the present invention in the position to permit removal of the door from the hinge bracket with the door partially removed; and FIG. 5 is a side elevational view, in section, showing the position of the mechanism of the present invention when the oven door has been completely removed from the hinge bracket in which the bracket is positioned in a locked position to accept return of the door.

DESCRIPTION OF THE PREFERRED EMBODIMENT

Figure 1:
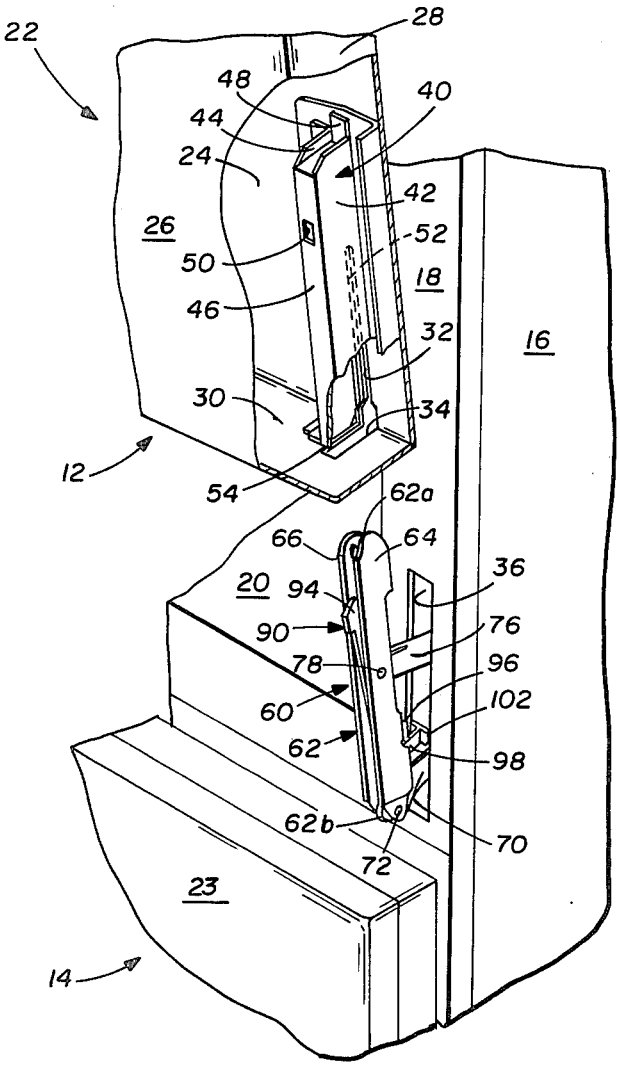
FIG. 1 is a perspective view of an oven structure having a removable hinged door using the hinge mechanism of the present invention, and an internal perspective view of the door channel frame.

FIG. 1 illustrates a typical dual oven, generally identified by the numeral 10. Oven 10 includes an upper oven and a lower oven, generally identified by the numerals 12 and 14. Upper oven 12 includes a side wall 16 and a front wall 18. Front wall 18 of upper oven 12 includes an access opening 20 to permit access to the interior cavity of upper oven 12. Access opening 20 is provided with a door, generally identified by the numeral 22. Similarly, lower oven 14 is provided with a door 23.

Door 22 is of the swing-down type, pivotable about a lower axis and is further removably hinged to oven 10. Door 22 is movable through a plurality of positions between a vertical closed position in which door 22 abuts against front wall 18 to close the access opening 20 and a substantially horizontal open position in which door 22 is substantially perpendicular to front wall 18 to provide access to the interior cavity of upper oven 12.

Door 22 includes an inner panel 24, outer panel 26, side panel 28 and a bottom panel 30. Inner panel 24 of door 22 includes an elongated aperture 32 and bottom panel 30 includes an aperture 34. When door 22 is mounted to upper oven 12, aperture 32 aligns with an aperture 36 contained within front wall 18 of upper oven 12. Inner panel 24 of door 44 also includes a sealing member 38 (FIG. 2) circumferentially disposed around the exterior edges of inner panel 24 to abut against front wall 18 of upper oven 12 and to prevent heat loss when door 22 is closed.

Door 22 further includes a channel frame generally identified by the numeral 40 through which door 22 is pivotally and removably mounted to upper oven 12. It will be understood that an identical channel frame is mounted on the opposite side of door 22. This mounting of the door allows for the pivotal movement between the door closed and open positions while allowing door 22 to be removable from upper oven 12. Channel frame 40 comprises a rectangular body having side walls 42 and 44 and end walls 46 and 48. End wall 46 includes a rectangular shaped aperture 50. End wall 48 of channel frame 40 includes an elongated aperture 52, which communicates with aperture 32 of inner panel 24 of door 22. Channel frame 40 further includes a bottom aperture 54, which communicates with aperture 34 contained within bottom panel 30 of door 22. Channel frame 40 is permanently affixed to inner panel 24 and bottom panel 30 of door 22 by riveting, welding or the like to secure channel frame 40 against movement relative to door 22.

Figure 2:
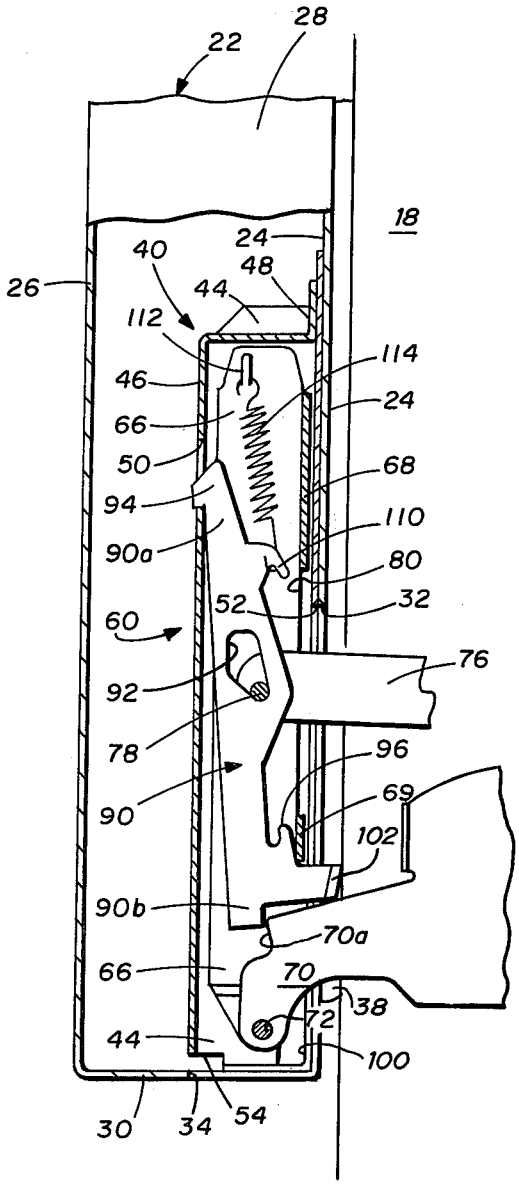
FIG. 2 is a side elevational view, in section, showing the position of the mechanism of the present invention in the locked position to prevent removal of the door from the hinge bracket.

Referring simultaneously to FIGS. 1 and 2, wherein like numerals are utilized for like and corresponding components, the hinge mechanism of the present invention is illustrated and is generally identified by the numeral 60. Hinge mechanism 60 includes a hinge bracket generally identified by the numeral 62 and having upper and lower ends **62*a* and 63*b* and side walls 64 and 66. Side walls 64 and 66 of hinge bracket 62 are interconnected through upper and lower end walls 68 and 69, which are more clearly illustrated in FIG. 2 where side wall 64 has been removed for clarity of illustration. Hinge bracket 62 is pivotally secured at its lower end 62*b* to a mounting arm 70 using a pivot pin 72. Mounting arm 70 extends through aperture 36 (FIG. 1) contained within front wall 18 of upper oven 12 and is mounted to side wall 16 in a conventional manner well known in the art. A second mounting arm 76 extends through aperture 36 in front wall 18 of upper oven 12. Arm 76 is pivotally mounted centrally between ends 62*a* and 62*b* of hinge mechanism 62 and between side walls 64 and 66 using a pivot pin 78. Mounting arm 76 extends through an aperture 80 defined between upper and lower end walls 68 and 69 of hinge bracket 62 and is spring biased to upper oven 12** in a manner well known in the art.

It therefore can be seen that channel frame 40 contained within door 22 is positioned and dimensioned to receive hinge bracket 62. Side walls 64 and 66 of hinge bracket 62 communicate with the interior portions of side walls 42 and 44 of channel frame 40 when the door 22 is positioned on the hinge bracket 62. Door 22 is therefore rendered pivotally cooperative with hinge bracket 62 and pivot pin 72 through the insertion of hinge bracket 62 into channel frame 40. Door 22 is therefore movable between the door closed position and the door open position as the door pivots about pivot pin 72. Furthermore, through the use of the present hinge mechanism 60, door 22 is removably hinged to hinge bracket 62 to allow door 22 to be easily and safely removed from upper oven 12 to provide access to the interior portions of upper oven 12.

Hinge mechanism 60 further includes a lever generally identified by the numeral 90 having upper and lower ends **90*a* and 90*b*. Lever 90 includes an aperture 92 centrally disposed between upper and lower ends 90*a* and 90*b* through which pivot pin 78 passes in order to mount arm 76 to hinge bracket 62. Upper end 90*a* of lever 90 includes a detent 94. Lower end 90*b* of lever 90 includes a detent 96. The operation of detents 94 and 96 will be subsequently explained. Lower end 90*b* of lever 90 further includes an extension arm 98, which extends through an aperture 100 disposed below lower end wall 69 of hinge bracket 62. Affixed to extension arm 98 is a T-shaped member 102 which is positioned substantially perpendicular to extension arm 98 of lever 90**.

Lever 90 further includes a finger 110 disposed centrally between upper end **90*a* and aperture 92 of lever 90. Side wall 66 of hinge bracket 62 includes a finger 112 for receiving one end of a spring 114, which extends between finger 110 of lever 90 and finger 112** of side wall 66. Alternatively, side wall 64 of hinge bracket 62 may include a finger similar to finger 112 for receiving one end of spring 114. Spring 114 biases lever 90 within hinge mechanism 62 between side walls 64 and 66.

Referring simultaneously to FIGS. 2, 3 and 4, wherein like numerals are utilized for like and corresponding elements, the operation of the present hinge mechanism 60 will be described. Referring specifically to FIG. 2, door 22 is illustrated in the vertical closed position in which door 22 prevents access to the interior portions of upper oven 12 by closing access opening 20. Hinge bracket 62 is disposed within channel frame 40 and through the operation of lever 90, hinge mechanism 62 is locked to channel frame 40 to prevent removal of door 22 from hinge mechanism 60 and upper oven 12.

FIG. 2 illustrates a first position of lever 90. In this first position, detent 94 of end 90*a* of lever 90 extends through aperture 50 of end wall 46 of channel frame 40 to lock hinge mechanism 62 to door 22. Door 22 cannot be removed from hinge mechanism 60 because of the position of detent 94 in aperture 50, to thereby prevent channel frame 40 from becoming disengaged from hinge bracket 62. In this first position it also can be seen that detent 96 of lever 90 is positioned adjacent lower end wall 69 and interior of side walls 64 and 66 of hinge mechanism 62. The operation of lever 90 prevents removal of door 22 from hinge mechanism 60 in all positions of door 22 as it moves through the plurality of positions from the vertical closed position to the horizontal open position. This aspect of the present invention is important in that door 22 cannot be inadvertently removed and because some positive action by the oven user is necessary in order to remove door 22 from oven 12.

This positive action required by the oven user to remove door 22 from upper oven 12 is illustrated in FIG. 3, which illustrates the operation of lever 90 to disengage detent 94 from aperture 50. Detent 94 of lever 90 is disengaged from aperture 50 contained within end wall 46 of channel frame 40, such that door 22 can be lifted off from hinge mechanism 62. In order to disengage detent 94 from aperture 50 the T-shaped structure 102 of lever 90 is depressed. Depressing T-shaped structure 102 causes lever 90 to pivot clockwise about pivot pin 78 of mounting arm 76, such that detent 94 is now contained within hinge mechanism 62 between side walls 64 and 66. This clockwise rotation of lever 90 also causes detent 96 to no longer contact lower end wall 69.

Referring simultaneously to FIGS. 3 and 4, the oven operator than exerts a downwardly directed force on extension arm 98 to cause pivot pin 78 to engage the upper corner of aperture 92 as shown in FIG. 3, thereby extending spring 114. This downwardly directed force causes detent 96 of lever 90 to align with aperture 100. The operator then exerts a horizontal directed force by grasping T-shaped member 102 to pivot lever 90 counterclockwise about pivot pin 78 of mounting arm 76, such that detent 96 moves through aperture 100 and external of side walls 64 and 66 of hinge bracket 62. Once removed from hinge bracket 62, detent 96 will be caused to engage lower end wall 69 due to the biasing force of spring 114 on lever 90, causing lever 90 to move upward. It can be seen from FIG. 4 that pivot pin 78 now engages the opposite corner of aperture 92 of lever 90 and is biased in this position under the force of spring 114. Hinge bracket 62 is therefore maintained in a second position as shown in FIG. 4 to permit removal of door 22 and the return of door 22 to hinge bracket 62.

Referring specifically to FIGS. 4 and 5 the position of hinge mechanism 60 to allow removal and replacement of door 22 is illustrated. In this second position of lever 90, detent 96 of lever 90 engages lower end wall 69 of hinge bracket 62. This engagement causes arm extension 98 to extend outwardly of hinge bracket 62, such that lower end 90*b* of lever 90 will engage edge 70*a* of mounting arm 70 as shown in FIG. 5. Lever 90, therefore, provides a stop mechanism to prevent hinge bracket 62 from abruptly moving towards front wall 18 of upper oven 12 as the counterbalancing effect of the weight of door 22 is removed from hinge bracket 62 and hinge bracket 62 is free to move under the force of the biasing spring attached to arm 76. This feature of the present invention, therefore, allows the safe removal of door 22 from upper oven 12 in that the oven user will not catch fingers or other portions of his body between hinge mechanism 62 and front wall 18 of upper oven 12.

In the process of returning door 22 to hinge mechanism 60, channel frame 40 is aligned to engage hinge bracket 62. After channel frame 40 engages hinge bracket 62 and door 22 is fully seated on hinge bracket 62, the oven user will disengage detent 96 from lower wall 69 by exerting a downwardly directed force on extension arm 98. The user will simultaneously cause a horizontally directed force to be imparted to extension arm 98 to rotate extension arm 98 in a clockwise direction through aperture 100 of hinge bracket 62. Lever 90, under the influence of spring 114 will therefore assume the first position as illustrated in FIG. 2. Detent 94 will then be engaged with aperture 50 and lever 90 will rotate counterclockwise about pivot pin 78 to lock door 22 onto hinge mechanism 60.

It will be understood that although one hinge mechanism 60 has been described, a similar hinge mechanism will be disposed on the oven side wall opposite side wall 16 of upper oven 12 to hingedly and removably attach the opposite side of door 22 to upper oven 12. Similarly, oven door 23 of lower oven 14 can be hingedly and removably attached to the side walls of lower oven 14.

It therefore can be seen that the hinge mechanism of the present invention provides a hinge to permit the easy removal of a hinged oven door while at the same time insuring the safety of the user. The hinge mechanism provides a locking feature to lock the door to the hinge mechanism at all times except when desired to be removed by the user. The hinge mechanism is maintained in a position to accept the return of an oven door, such that no realignment of the hinge and door is necessary to replace the door to the oven. The hinge mechanism further prevents a hinge bracket from moving under the force of a biasing spring to prevent injury to the oven user when removing the oven door.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In a removable hinged door for an oven housing having an access opening to be covered by the door, the door movable through a plurality of positions between a substantially vertical closed position over the access opening and a substantially horizontal open position to provide access to the oven housing the combination comprising:

a hinge bracket pivotally secured to the oven housing;

a channel frame secured within the door for receiving said hinge bracket for rendering the door pivotally cooperative with said hinge bracket for movement between the door closed position and the door open position;

a lever secured to said hinge bracket for movement between first and second positions, such that in said first position said lever engages said channel frame to prevent removal of the door from said hinge bracket, and in said second position said lever disengages from said channel frame to permit removal of the door from said hinge bracket and further maintains said hinge bracket in a predetermined fixed position with respect to the oven housing when the door is removed from said hinge bracket; and means extending from said lever for moving said lever between said first and second positions.

2. The combination of claim 1 wherein said lever includes detent means for engaging said channel frame to prevent removal of the door from said hinge bracket in said first position.

3. The combination of claim 1 wherein said lever further includes stop means for maintaining said hinge bracket in said predetermined fixed position in said second position.

4. In a removable hinged door for an oven housing having an access opening to be covered by the door, the door movable through a plurality of positions between a substantially vertical closed position over the access opening and a substantially horizontal open position to provide access to the oven housing the combination comprising:

a hinge bracket pivotally secured to the oven housing;

a channel frame secured within the door for receiving said hinge bracket for rendering the door pivotally cooperative with said hinge bracket for movement between the door closed position and the door open position;

a lever secured to said hinge bracket for movement between first and second positions, such that in said first position said lever engages said channel frame to prevent removal of the door from said hinge bracket, and in said second position said lever disengages from said channel frame to permit removal of the door from said hinge bracket and further maintains said hinge bracket in a predetermined fixed position with respect to the oven housing when the door is removed from said hinge bracket; and said lever including detent means for engaging said hinge bracket to maintain said hinge bracket in said predetermined fixed position in said second position.

5. In a removable hinged door for an oven housing having an access opening to be covered by the door, the door movable through a plurality of positions between a substantially vertical closed position over the access opening and a substantially horizontal open position to provide access to the oven housing the combination comprising:

a hinge bracket pivotally secured to the oven housing;

a channel frame secured within the door for receiving said hinge bracket for rendering the door pivotally cooperative with said hinge bracket for movement between the door closed position and the door open position;

a lever secured to said hinge bracket for movement between first and second positions, such that in said first position said lever engages said channel frame to prevent removal of the door from said hinge bracket, and in said second position said lever disengages from said channel frame to permit removal of the door from said hinge bracket and further maintains said hinge bracket in a predetermined fixed position with respect to the oven housing when the door is removed from said hinge bracket; and means for biasing said lever to said hinge bracket.

6. A mechanism for use with a removable hinged door for an oven structure having an access opening to be covered by the door, the door movable through a plurality of positions between a substantially vertical closed position where the door closes the access opening and a substantially horizontal open position to permit access to the oven structure, comprising:

a hinge bracket pivotally secured to the oven structure;

a channel frame secured within the door and dimensioned for slidable engagement with said hinge bracket for rendering the door pivotally cooperative with said hinge bracket for movement between the door closed position and the door open position;

a lever operatively associated with said hinge bracket having first and second ends and movable between first and second positions;

said first end of said lever including first detent means for engaging, in said first lever position, said channel frame to prevent removal of the door from said hinge bracket; and said second end of said lever including second detent means for engaging, in said lever second position, said hinge bracket to maintain said hinge bracket in a predetermined fixed position with respect to the oven structure when the door is removed from said hinge bracket.

7. The mechanism of claim 6 wherein said second end of said lever further includes means for moving said lever between said first and second positions.

8. The mechanism of claim 7 wherein said lever further includes stop means for maintaining said hinge bracket in said predetermined fixed position when the door is removed from said hinge bracket.

9. The mechanism of claim 8 and further including spring means attached between said lever and said hinge bracket for biasing said lever to said hinge bracket.

10. The mechanism of claim 8 wherein said lever is housed within said hinge bracket.

11. The mechanism of claim 8 wherein said lever further includes finger means for receiving said spring means.

12. A mechanism for use with a removable hinged door for an oven structure having an access opening to be covered by the door, the door movable through a plurality of positions between a substantially vertical closed position where the door closes the access opening and a substantially horizontal open position to permit access to the oven structure, comprising:

a hinge bracket pivotally secured to the oven structure;

a channel frame secured within the door and dimensioned for slidable engagement with said hinge bracket for rendering the door pivotally cooperative with saaid hinge bracket for movement between the door closed position and the door open position;

a lever operatively associated with said hinge bracket and having first and second ends movable between first and second positions;

said first end of said lever including first detent means for engaging, in said first lever position, said channel frame to prevent removal of the door from said hinge bracket and for disengaging, in said second lever position, said channel frame to permit removal of the door from said hinge bracket;

said second end of said lever including second detent means for engaging, in said lever second position, said hinge bracket to maintain said hinge bracket in a predetermined fixed position with respect to the oven structure when the door is removed from said hinge bracket; and said second end of said lever further including means for moving said lever between said first, and second positions.

13. The mechanism of claim 12 wherein said lever further includes stop means for maintaining said hinge bracket in said predetermined fixed position when the door is removed from said hinge bracket.

14. The mechanism of claim 12 and further including spring means attached between said lever and said hinge bracket for biasing said lever to said hinge bracket.

15. The mechanism of claim 14 wherein said lever is housed within said hinge bracket.

16. The mechanism of claim 14 wherein said lever further includes finger means for receiving said spring means.

17. A mechanism for use with a removable hinged door for an oven structure comprising:

a hinge bracket pivotally secured to the oven structure;

a channel frame secured within the door for slidable engagement with said hinge bracket for removably mounting the door thereto;

a lever having first and second ends housed within said hinge bracket and pivotally secured to said hinge bracket at a point centrally disposed between said lever first and second ends for movement between first and second positions;

said first end of said lever including first detent means extending from said hinge bracket in said lever first position for engaging said channel frame to prevent removal of the door from said hinge bracket and being retractable into said hinge bracket in said second position to disengage from said channel frame to permit removal of the door from said hinge bracket;

said second end of said lever including second detent means extending from said hinge bracket in said second position for engaging said hinge bracket to maintain said hinge bracket in a predetermined position with respect to the oven structure when the door is removed from said hinge bracket, said second detent means being retractable within said hinge bracket when the door is mounted to said hinge bracket;

means mounted to said second end of said lever extending outwardly from said hinge bracket and the door for actuating said lever for movement between said first and second lever positions and for maintaining said hinge bracket in said predetermined fixed position in said third lever position to accept return of the door; and spring means having first and second ends contained within said hinge bracket for biasing said lever to said hinge bracket, said first end of said spring means being attached to said hinge bracket and said second end of said spring means being attached to said lever.

18. The mechanism of claim 17 wherein said lever further includes finger means for receiving said second end of said spring means.

19. The mechanism of claim 18 wherein said lever includes a slotted aperture centrally disposed between said first and second lever ends for pivotally mounting said lever to said hinge bracket and for allowing of said lever between said first and second positions.

* * * * *

UNITED STATES PATENT AND TRADEMARK OFFICE

CERTIFICATE OF CORRECTION

PATENT NO. : 4,194,321

DATED : March 25, 1980

INVENTOR(S) : Gerald W. Hess

It is certified that error appears in the above-identified patent and that said Letters Patent are hereby corrected as shown below:

Column 1, line 35 change "mechanism" to --mechanisms--.
Column 5, line 52 change "than" to --then--.
Column 9, line 7 change "saaid" to --said--.
Column 10, line 45 after "allowing" insert --movement--.

Signed and Sealed this

*Twenty-second* Day of *July 1980*

[SEAL]

*Attest:*

SIDNEY A. DIAMOND

*Attesting Officer*

*Commissioner of Patents and Trademarks*